US005161200A

United States Patent [19]

Barr

[11] Patent Number: 5,161,200

[45] Date of Patent: Nov. 3, 1992

[54] MICROPHONE

[75] Inventor: Keith Barr, Los Angeles, Calif.

[73] Assignee: Alesis Corporation, Los Angeles, Calif.

[21] Appl. No.: 389,771

[22] Filed: Aug. 4, 1989

[51] Int. Cl.[5] ..... H04R 25/00

[52] U.S. Cl. ..... 381/173; 381/190; 381/191; 310/324

[58] Field of Search ..... 381/173, 168, 174, 176, 381/191, 190; 181/167; 340/384 E; 310/324

[56] References Cited

U.S. PATENT DOCUMENTS

| | | | |
|---|---|---|---|
| 2,614,144 | 10/1952 | Howatt | 381/173 |
| 3,403,234 | 9/1968 | Barnes, Jr. | 381/174 |
| 3,736,632 | 6/1973 | Barrow | 381/173 |
| 3,943,388 | 3/1976 | Massa | 381/173 |
| 4,291,781 | 9/1981 | Niguchi et al. | 181/169 |
| 4,726,443 | 2/1988 | Ugaji et al. | 181/167 |
| 4,843,275 | 6/1989 | Radice | 381/190 |
| 4,906,840 | 3/1990 | Zdeblick et al. | 310/332 |

*Primary Examiner*—Forester W. Isen

*Assistant Examiner*—Jason Chan

*Attorney, Agent, or Firm*—Hecker & Harriman

[57] ABSTRACT

The present invention is directed to a microphone in which all elements having mass which can affect the output of the microphone have a resonant frequency outside the frequency range of interest. The present invention utilizes a relatively stiff diaphragm having low density, which is at the same time thin. The diaphragm is designed to have a resonant frequency outside the range of interest. The diaphragm and the sensor are a single assembly in the preferred embodiment of the present invention. The assembly comprises a diaphragm made of a ceramic material having the properties of stiffness and low density. The sensor is a piezo electric disk coupled to the diaphragm. The sensor/diaphragm assembly is mounted in a housing so as to have a reference air space behind the assembly. The sensor is metallized to provide electrical conductivity. The reference air space is kept separate from the atmosphere and the resonant frequency of the assembly and air space is higher than the selected frequency range.

16 Claims, 1 Drawing Sheet

MICROPHONE

BACKGROUND OF THE PRESENT INVENTION

1. FIELD OF THE INVENTION

This invention relates to the field of microphones and in particular to a microphone having a flat frequency response over a selected frequency range.

2. BACKGROUND ART

In certain audio applications, it is desired to provide a sensing microphone to monitor audio output over a specified frequency range. In such applications, it is desired that the frequency response of the microphone over the frequency range be substantially "flat". That is, the amplitude of the output signal generated by the microphone should be substantially constant regardless of the frequency of the input signal. In the prior art, it has been difficult to provide a microphone with such flat frequency response. One problem associated with the prior art microphones is the resonant frequency of various elements of the microphone. For example, at the resonant frequency of a microphone diaphragm, the frequency response spikes to a high amplitude. A prior art attempt to solve this problem is to use a relatively flexible diaphragm which is acoustically dampened to compensate for this resonant frequency.

Another prior art attempt to provide a flat frequency response is to utilize post sampling filtering to compensate for peaks and valleys in the frequency response output curve of the microphone.

One type of prior art microphone is a condenser microphone which utilizes a stretched membrane diaphragm. However, multiple resonances can occur within the stretched membrane leading to variable frequency response characteristics.

Prior art microphones utilize a diaphragm which is flexible and low in mass. Such a diaphragm is chosen to minimize the Q value so that compensation at the resonant frequency can be achieved. A certain degree of flexibility is also required in the diaphragm for sensitivity in the desired frequency range and amplitude range.

One prior art microphone is illustrated in Imay, U.S. Pat. No. 4,559,418. Imay is directed to a ceramic microphone having a diaphragm for receiving soundwaves and a thin ceramic plate coupled to the diaphragm for transducing the soundwaves to electric signals. A number of N divided electrodes are provided where N is an integer greater than 2 to act as serially-connected capacitors to multiply the voltage of the microphone output by a factor of N.

Another prior art microphone is described in Dunn, U.S. Pat. No. 4,431,873. Dunn relates to an omni-directional acoustic sensor with an air-backed diaphragm, with a piezo electric disk attached to each side of the diaphragm.

U.S. Pat. No. 4,734,611 to Granz relates to an ultrasonic sensor in which a polymer foil is piezo-electrically activated in a partial section. The connecting electrodes are spatially separated from the activated section, resulting in the ability to measure high pressure amplitude shock waves. The piezo section of Granz is isolated from a substrate or electrode.

A pipe-measuring device comprising a transducer having a flexible piezo electric layer as a sensor element is described in Ingle, U.S. Pat. No. 4,737,676. A piezo layer is applied directly onto a metal foil layer. An electrode is then coupled to the piezo layer and the device is used to measure mechanical movement of pipes.

None of these prior art microphones address the problem of response variation at the resonant frequency of microphone components.

Therefore, it is an object of the present invention to provide a microphone having a substantially uniform response over a desired range of frequencies.

It is another object of the present invention to provide a microphone in which the effects of the resonant frequency of microphone components is eliminated in the desired frequency range.

SUMMARY OF THE PRESENT INVENTION

The present invention is directed to a microphone in which all elements having mass which can affect the output of the microphone have a resonant frequency outside the frequency range of interest. The present invention utilizes a relatively stiff diaphragm having low density, which is at the same time thin. The diaphragm is designed to have a resonant frequency outside the range of interest.

The diaphragm and the sensor are a single assembly in the preferred embodiment of the present invention. The assembly comprises a diaphragm made of a ceramic or other material having the properties of stiffness and low density. The sensor is a piezo electric disk coupled to the diaphragm.

The sensor/diaphragm assembly is mounted in a housing so as to have a reference air space behind the assembly. The sensor is metallized to provide electrical conductivity. The reference air space is kept separate from the atmosphere and the resonant frequency of the assembly and air space is higher than the selected frequency range.

DETAILED DESCRIPTION OF THE PRESENT INVENTION

Figure 2:
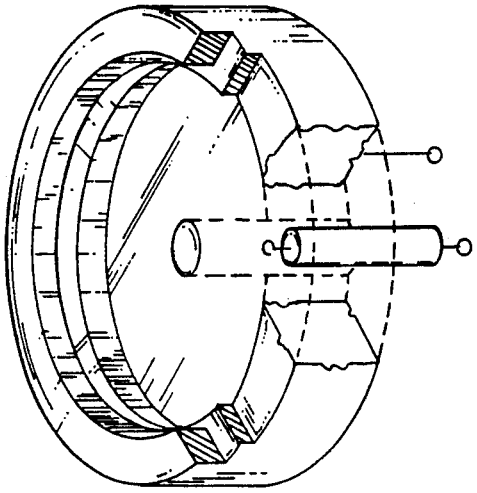
FIG. 2 is a perspective of the microphone of FIG. 1.

An improved microphone which provides a substantially flat frequency response over a desired range is described. In the following description, numerous specific details, such as diaphragm diameter and thickness, etc., are set forth to provide a more thorough description of the present invention. It will be apparent, however, to one skilled in the art, that the present invention may be practiced without these specific details. In other instances, well known features have not been described so as not to obscure the present invention.

The present invention provides a microphone where each individual component has a resonant frequency above the desired frequency range of interest. Further, the resonant frequency of the combination of components is outside the desired frequency range as well.

In the preferred embodiment of the present invention, the desired frequency range of interest is approximately 10 to 20,000 Hz. The present invention contemplates a microphone assembly where the components have a resonant frequency substantially above that frequency range, on the order of 30–40 kHz.

The present invention comprises a housing, diaphragm, sensor and reference air space. To make the diaphragm as sensitive as possible, to detect sound at all frequencies in the range of interest, the diaphragm must be light weight and have a high elastic modulus. The diaphragm must also be thin and compliant, yet be of low density so as to have a high resonant frequency.

In the past, it has not been possible to provide a microphone with a "high" (i.e., above the range of interest) resonant frequency while still providing sensitivity below the resonant point where the output voltage is directly proportional to pressure applied to the diaphragm. The present invention utilizes a ceramic diaphragm and a piezo electric sensor in a sensor/diaphragm assembly (S/D assembly). The piezo electric sensor has a stress-to-output voltage relationship which is linear and predictable The S/D assembly is mounted adjacent to a reference air space such that the S/D assembly can be acted on by pressures in the atmosphere relative to the fixed pressure within the reference air space. The entire microphone is such that the resonant frequency of the diaphragm is substantially above the highest frequency of interest.

The present invention differs from prior art microphones in its use of a relatively stiff diaphragm. To improve sensitivity for low amplitude signals, the prior art teaches away from the use of a stiff diaphragm. Instead, the prior art teaches the use of a flexible diaphragm. However, the flexible diaphragms of the prior art lack flat frequency response over the desired frequency range. The prior art teaches the use of flexible diaphragms, typically for voice applications for low amplitude sensitivity. However, the present invention is contemplated for use as a sound analyzing device where a flat frequency response is at a premium and low amplitude detection is not necessarily required.

Figure 1:
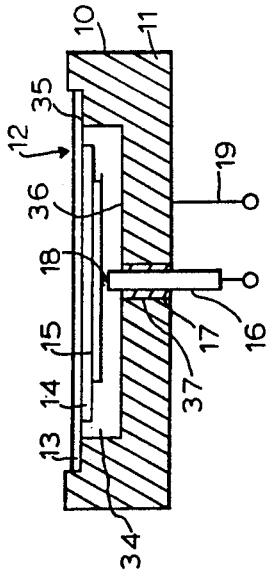
FIG. 1 is a side view of the preferred embodiment of the present invention.

A cross sectional view of the preferred embodiment of the present invention is illustrated in FIG. 1. The present invention 10 comprises a housing 11, sensor 14, diaphragm 13 and reference air space 34. The housing 11 is comprised of brass in the preferred embodiment of the present invention. The housing 11 is substantially circular (FIG. 2) with a first recessed area defined by ledge 35 for receiving the sensor diaphragm assembly 12. A second recessed area defined by lower surface 36 defines a reference air space 34. The reference air space 34 is located between the S/D assembly 12 and the lower surface 36. The housing 11 keeps the reference air space 34 separate from the atmosphere.

The housing 11 includes an axial opening 37 for receiving an electrode 16. The housing 11 is preferably a single piece of brass, machined or formed into the desired shape and dimensions. In the present invention, the housing is approximately 1 cm in diameter and 0.5 cm in height. The first ledge 35 is approximately 0.5 mm from the upper surface of the housing. The lower surface 36 is approximately 1 mm below the ledge 35 to define the reference air space. The reference air space can be adjusted in design, as a smaller space leads to reduced sensitivity and a larger space decreases the resonant frequency of the space, which can, if too low, affect response. The reference air space should be a fraction of a wave length of the maximum frequency of interest, such as 1/10 of a wave length in depth, to prevent the generation of standing waves. Also, the space should not be too small, as thermodynamic effects could be created due to pressure changes in the resident air. The nominal dimension of the reference air space in the preferred embodiment of our present invention is 0.1 to 0.5 cm in depth.

Although the housing 11 is comprised of brass in the preferred embodiment of the present invention, any suitable material with a resonant frequency outside the desired frequency range may be utilized without departing from the scope of the present invention. A conductive material such as steel or aluminum is preferred.

An electrode 16 extends through the opening 37 in the housing 11 to provide electrical connection to the S/D assembly 12. The electrode 16 is electrically isolated from the housing 11 by means of insulation 17. The electrode 16 includes a connecting wire 18 to make electrical connection to the S/D assembly 12. The connecting wire 18 is curved for compliance. The resonant frequency of this wire should also be made above the range of interest in the preferred embodiment. Alternatively, if the wire is small enough, its resonant frequency can be ignored. A second electrode 19 is coupled to the housing 11.

The S/D assembly 12 consists of a diaphragm 13 and sensor 14. The diaphragm 13 reacts to pressures created by soundwaves and deflects as a result of those pressures. The sensor 14 is used to detect the movement of the diaphragm 13 and provides an electrical signal proportional to the amount of deflection of the diaphragm.

The S/D assembly 12 combines the sensor and diaphragm in the preferred embodiment of the present invention. The diaphragm 13 consists of a ceramic material approximately 1 cm in diameter and one-tenth of a millimeter in thickness. The diaphragm 13 must be relatively stiff and have low density, but at the same time be thin. As with the other significant components of the present invention, the resonant frequency of the diaphragm should be above the frequency range of interest. In the preferred embodiment, the diaphragm is a disk comprised of alumina ($Al_2O_3$) which has a high elastic modulus (on the order of 60 million PSI) and a very low density (on the order of 3.8 g/cm$^3$). Other suitable materials include beryllia and berylium oxide. Any material from the class of ceramics having a high elastic modulus and low density may be utilized in the scope of the present invention. The material should have an elastic modulus in the range of 20 million to 100 million PSI and a density in the range of 1.8–6 g/cm$^3$. The diaphragm 13 is coupled to the housing 11 at ledge 35 with an epoxy bonding or other suitable attachment means.

The sensor 14 is a piezo electric material having a substantially linear voltage output over the desired frequency range. A suitable sensor may be a piezo electric ceramic such as a barium-type ceramic. The sensor is coupled to the diaphragm with epoxy. In the preferred embodiment, the sensor is approximately 0.75 cm in diameter and approximately one-tenth of a millimeter in thickness. Both the diaphragm and sensor are substantially circular in shape concentric with the housing 11. The sensor 14 includes a metallization layer 15 to provide electrical connection through wire 18 to electrode 16.

Figure 3:
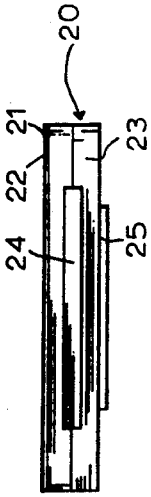
FIG. 3 is a side view of an alternate embodiment of the sensor diaphragm assembly of the present invention.

An alternate embodiment of the diaphragm S/D assembly of the present invention is illustrated in FIG. 3. In this embodiment, a double element configuration is used. A first diaphragm member 22 is coupled to a second diaphragm member 23. The cross section of the elements 22 and 23 define a shallow "U" shape so that a cavity is formed between the elements when they are joined. This cavity receives a metal layer 24 to provide electrical connection between the two. The upper element 22 includes a metallization layer 21 extending across the upper surface of the element 22. The lower element 23 includes a metallization layer 25 extending partially across the lower surface thereof.

In this embodiment, the elements 22 and 23 are polarized oppositely. The polarization can be achieved by putting one element in compression and the other in tension so that charges of opposite polarity are produced upon deflection of the materials.

Figure 4:
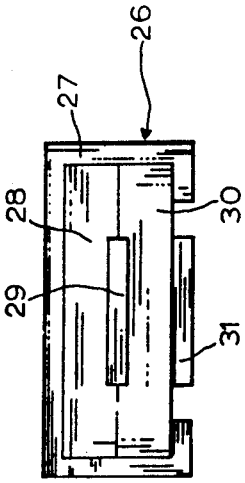
FIG. 4 is a side view of a second alternate embodiment of the sensor diaphragm assembly of the present invention.

A second alternate embodiment 26 is illustrated in FIG. 4. This embodiment is similar to the embodiment of FIG. 3 in that two ceramic members 28 and 30, polarized oppositely, are coupled together to form a cavity therebetween. The cavity receives a metallization layer 29 to provide electrical conductivity between the ceramic members 28 and 30.

A metallization layer 31 extends partially across the lower surface of member 30. A second metallization layer 27 is formed in a "wrap around" fashion around the entire assembly. The metallization layer 27 extends across the entire upper surface of member 28, encloses the sides of both members 28 and 30 and extends partially across the lower surface of member 30 without contacting metallization layer 31. The metallization layer 27 in this embodiment is a polymer which is painted onto the ceramic assembly. Although it may be possible to fire the metallization layer on, this may neutralize the polarization of the ceramic members 28 and 30.

The embodiments illustrated in FIGS. 3 and 4 provide assemblies where the diaphragm is the sensor (no separate sensor is required). The embodiments of FIGS. 3 and 4 have the advantage of a very high mechanical Q. A high Q results in a broad band of frequencies which are not affected by the resonance of the component.

Figure 5:
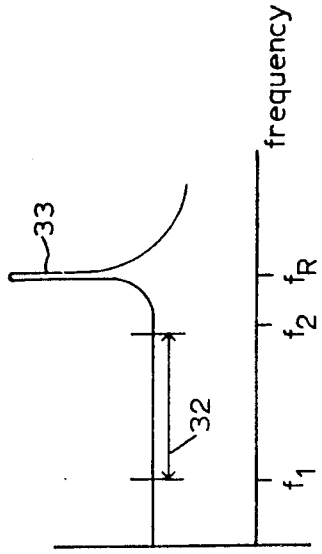
FIG. 5 is a frequency response curve of the present invention.

An example of the frequency response of the present invention is illustrated in FIG. 5. The frequency range of interest, $f_1$–$f_2$, provides a sharp peak 33 in response. Because the resonant frequency, $f_R$, is isolated from the desired frequency range in the present invention, a substantially flat output can be obtained.

Thus, a microphone having improved response characteristics is described.

I claim:

1. A microphone for detecting sound waves in a desired frequency range with a sensitivity that is substantially invariant over said desired frequency range comprising:

a housing having a recessed area formed therein;

sensing means for detecting said sound waves and providing a signal dependent on said sound waves, said sensing means comprising a diaphragm and a sensor, said sensing means coupled to said housing so as to form a reference air space in said recessed area between said housing and said sensing means;

said housing and said sensing means each having a resonant frequency substantially outside of said desired frequency range.

2. The microphone of claim 1 wherein said housing is substantially circular and has a first anular ledge formed in said recessed area for receiving said sensing means.

3. The microphone of claim 1 wherein said diaphragm has a modulus of elasticity in the range of 20 million to 100 million PSI and a density in the range of 1.8–6 g/cm$^3$.

4. The microphone of claim 3 wherein said diaphragm is comprised of alumina.

5. The microphone of claim 1 wherein said sensor comprises a piezo electric element.

6. The microphone of claim 5 wherein said sensor is comprised of a ceramic material.

7. The microphone of claim 6 wherein said sensor is comprised of barium titanate.

8. The microphone of claim 1 wherein said desired frequency range is the range 10 to 20,000 Hz.

9. The microphone of claim 1 wherein said housing and said sensing means each have a resonant frequency above said desired frequency range.

10. A microphone for detecting sound waves in a desired frequency range comprising:

sensing means responsive to said sound waves and for providing a signal with an amplitude that is substantially independent of the frequency of said sound waves in said desired frequency range;

a housing for receiving said sensing means; said housing having a recessed area for defining a reference air space between said housing and said sensing means;

said reference air space isolated from the atmosphere external to said microphone;

said housing and said sensing means each having a resonant frequency substantially above said desired frequency range.

11. The microphone of claim 10 wherein said sensing means comprises a diaphragm coupled to a sensor, said diaphragm having a modulus of elasticity in the range 20–100 million PSI and a density in the range of 1.8–6 g/cm$^3$.

12. The microphone of claim 11 wherein said diaphragm is comprised of alumina.

13. The microphone of claim 11 wherein said sensor is a piezo electric element.

14. The microphone of claim 10 wherein said sensing means comprises a first ceramic element having a first polarity coupled to a second ceramic element having a second polarity, said first and second ceramic elements having a cavity formed therebetween;

a first metal layer formed in said cavity;

a second metal layer formed on an upper surface of said first ceramic element;

a third metal layer formed on a portion of a lower surface of said second ceramic element;

said first and second ceramic elements having a resonant frequency outside said desired frequency range.

15. The microphone of claim 10 wherein said sensing means comprises a first ceramic element having a first polarity coupled to a second ceramic element having a second polarity, said first and second ceramic elements having a cavity formed therebetween;

a first metal layer formed in said cavity;

a second metal layer formed on an upper surface of said first ceramic element and extending about the sides of said first and second ceramic elements and extending partially onto a lower surface of said second ceramic element;

a third metal layer formed on a portion of said lower surface of said second ceramic element, said third metal layer electrically independent of said second metal layer;

said first and second ceramic elements having a resonant frequency outside said desired frequency range.

16. A microphone for detecting sound waves in a desired frequency range comprising:

sensing means responsive to said sound waves and for providing a signal with an amplitude that is substantially independent of the frequency of said sound waves in said desired frequency range;

a housing for receiving said sensing means; said housing having a recessed area for defining a reference air space between said housing and said sensing means;

said reference air space isolated from the atmosphere external to said microphone;

said housing and said sensing means each having a resonant frequency substantially above said desired frequency range;

said sensing means comprising a first ceramic element having a first polarity coupled to a second ceramic element having a second polarity, said first and second ceramic elements having a cavity formed therebetween;

a first metal layer formed in said cavity;

a second metal layer formed on an upper surface of said first ceramic element and extending about the sides of said first and second ceramic elements and extending partially onto a lower surface of said second ceramic element;

a third metal layer formed on a portion of said lower surface of said second ceramic element, said third metal layer electrically independent of said second metal layer;

said first and second ceramic elements having a resonant frequency outside said desired frequency range.

* * * * *